US009500014B2

(12) United States Patent
Nielsen et al.

(10) Patent No.: US 9,500,014 B2
(45) Date of Patent: Nov. 22, 2016

(54) LOCKING HINGE WITH SPHERICAL BEARING ASSEMBLIES

(71) Applicant: HARTWELL CORPORATION, Placentia, CA (US)

(72) Inventors: Douglas Soren Nielsen, Placentia, CA (US); Timothy S. Rozema, Placentia, CA (US)

(73) Assignee: Hartwell Corporation, Placentia, CA (US)

( * ) Notice: Subject to any disclaimer, the term of this patent is extended or adjusted under 35 U.S.C. 154(b) by 0 days.

(21) Appl. No.: 14/436,420

(22) PCT Filed: Oct. 17, 2013

(86) PCT No.: PCT/US2013/065525

§ 371 (c)(1),
(2) Date: Apr. 16, 2015

(87) PCT Pub. No.: WO2014/062971

PCT Pub. Date: Apr. 24, 2014

(65) Prior Publication Data

US 2015/0252602 A1 Sep. 10, 2015

Related U.S. Application Data

(60) Provisional application No. 61/714,916, filed on Oct. 17, 2012.

(51) Int. Cl.
*E05D 11/06* (2006.01)
*E05D 3/10* (2006.01)
(Continued)

(52) U.S. Cl.
CPC ..... *E05D 11/04* (2013.01); *E05D 11/06* (2013.01); *E05D 11/1014* (2013.01);
(Continued)

(58) Field of Classification Search
CPC ..... Y10T 16/5377; Y10T 16/5379; Y10T 16/5402; Y10T 16/54024; Y10T 16/540247;
(Continued)

(56) References Cited

U.S. PATENT DOCUMENTS 2,143,736 A 6/1936 Lafevre
2,791,794 A 5/1957 Burns
(Continued)

FOREIGN PATENT DOCUMENTS

CN 2795388 Y 6/2006
CN 201326328 Y 10/2009
FR 2901241 11/2007

OTHER PUBLICATIONS

Search Report and Written Opinion issued in App. No. PCT/US2013/065525 (2014).
(Continued)

*Primary Examiner* — Chuck Mah
(74) *Attorney, Agent, or Firm* — Barnes & Thornburg LLP

(57) ABSTRACT

The present disclosure includes a hinge assembly for use in a hinged attachment of a panel relative to a frame and providing movement of the panel relative to the frame. A link which provides an extension or reach motion and positioning of the assembly, shown for purposes of illustration and not limitation in the form of a gooseneck arm, is provided in the hinge assembly to facilitate an extended range of motion of the hinge assembly. A first spherical bearing assembly and a second spherical bearing assembly are operatively associated with a bearing end of the link to provide multiple degrees of motion while securely retaining the panel relative to the frame. The hinge is intended to provide universal application of a single version of a hinge which can be used in multiple locations as facilitated by the multiple degrees of motion provided by the bearing end of the link.

19 Claims, 7 Drawing Sheets

(51) Int. Cl.
*E05D 11/04* (2006.01)
*E05D 11/10* (2006.01)
*E05D 5/06* (2006.01)

(52) U.S. Cl.
CPC .... *E05D 2005/067* (2013.01); *E05Y 2201/636* (2013.01); *E05Y 2900/502* (2013.01); *Y10T 16/5377* (2015.01)

(58) Field of Classification Search
CPC ..... Y10T 16/54026; Y10T 16/54048; Y10T 16/5409; Y10T 16/53885; Y10T 16/5389; Y10T 16/53834; Y10T 16/5385; Y10T 16/544; Y10T 16/5443; Y10T 16/5444; Y10T 16/5445; E05D 11/04; E05D 11/045; E05D 11/06; E05D 11/1085; E05D 11/1007; E05D 2005/067; E05D 5/062; E05D 3/127; E05D 3/145; E05D 3/18; E05D 3/12; E05Y 2900/502; E05Y 2900/50; E05Y 2900/548; E05Y 2900/536; E05Y 2900/546; E05Y 2900/531; E05Y 2201/416; E05F 1/123; E05F 1/1238; E05F 1/1033; E05F 1/1276; E05F 1/1284; E05F 5/022
See application file for complete search history.

(56) References Cited

U.S. PATENT DOCUMENTS 2,947,025 A * 8/1960 Campbell ..... E05D 1/04 16/275
2,995,192 A * 8/1961 Scheutzow ..... B64C 27/37 416/114
3,349,429 A * 10/1967 Suska ..... E05D 3/02 16/275
3,404,486 A * 10/1968 Erwin ..... E05F 1/1253 16/224
3,806,158 A * 4/1974 Casey ..... B62D 53/02 280/400
4,524,485 A * 6/1985 Harris ..... B64C 7/02 16/364
4,693,698 A * 9/1987 Olson, II ..... F16D 3/2055 464/111
5,050,270 A 9/1991 Burgei et al.
5,074,609 A * 12/1991 Dear ..... E05D 7/0045 16/235
5,195,796 A * 3/1993 Wampler ..... E05D 3/18 16/358
5,203,525 A * 4/1993 Remlaoui ..... B64D 29/06 16/369
5,208,945 A * 5/1993 Dodd ..... E05D 1/04 16/358
2,343,810 A 3/1994 Schonitzer
5,365,639 A * 11/1994 Lewkoski ..... E05D 7/0423 16/224
5,709,522 A * 1/1998 Cullum ..... B60P 3/125 280/402
5,864,320 A * 1/1999 Baghdasarian ..... B64G 1/22 16/335
5,893,518 A * 4/1999 Bruchez, Jr. ..... F02K 1/12 239/265.39
5,946,774 A 9/1999 Ramsey et al.
5,967,586 A * 10/1999 Duffy ..... E05D 7/0045 16/235
6,141,829 A * 11/2000 Boyer ..... E05D 7/043 16/224
6,149,222 A * 11/2000 Schambre ..... E05D 3/10 16/334
6,292,981 B1 9/2001 Ford et al.
6,382,704 B1 * 5/2002 Nastasoiu ..... E05D 5/062 16/298
6,401,299 B1 6/2002 Schwarz
6,585,307 B1 * 7/2003 Queveau ..... B60J 7/205 296/107.08
7,930,801 B2 * 4/2011 Hilger ..... E05F 7/06 16/18 R
2001/0054257 A1 * 12/2001 Wygle ..... E05F 15/619 49/349
2002/0070092 A1 * 6/2002 Ransil ..... B65G 13/12 193/37
2008/0018131 A1 * 1/2008 Heath ..... E05D 5/062 296/76
2008/0040886 A1 * 2/2008 Arnold ..... B64C 9/16 16/275
2008/0083089 A1 4/2008 Hoffman
2008/0128548 A1 * 6/2008 Simkulet ..... B64C 5/02 244/87
2010/0096505 A1 * 4/2010 De Freitas ..... B64C 1/143 244/129.5
2013/0270988 A1 * 10/2013 Nicholson ..... A47B 81/00 312/400

OTHER PUBLICATIONS

Office Action issued in application No. CN 201380062616.5 (issued Mar. 24, 2016).
Supplementary Search Report issued in App. No. EP 13847170.1 (Jun. 22, 2016).

* cited by examiner

LOCKING HINGE WITH SPHERICAL BEARING ASSEMBLIES

CROSS REFERENCE TO RELATED APPLICATIONS

This application is a U.S. nationalization under 35 U.S.C. §371 of International Application No. PCT/US2013/065525, filed Oct. 17, 2013, which claims the benefit of priority under 35 U.S.C. §119(e) to U.S. Provisional Patent Application No. 61/714,916, filed Oct. 17, 2012. The disclosures set forth in the referenced applications are incorporated herein by reference in their entireties.

BACKGROUND

The present disclosure includes a hinge assembly for use in a hinged attachment of a panel relative to a frame and providing movement of the panel relative to the frame. A link which provides an extension or reach motion and positioning of the assembly, shown for purposes of illustration and not limitation in the form of a gooseneck arm, is provided in the hinge assembly to facilitate an extended range of motion of the hinge assembly. A first spherical bearing assembly and a second spherical bearing assembly are operatively associated with a bearing end of the link to provide multiple degrees of motion while securely retaining the panel relative to the frame. The hinge is intended to provide universal application of a single version of a hinge which can be used in multiple locations as facilitated by the multiple degrees of motion provided by the bearing end of the link.

By way of background, a variety of gooseneck hinges have been developed for attachment of a panel or door to a frame. Such gooseneck assemblies provide a plate and flange attached to a frame with a gooseneck arm pivotally attached to the flange. A point of rotation allows the arm to move relative to the flange. The arm generally extends along a predefined path and includes attachment points such as a corresponding plate and flange assembly on an end distal from the frame end attached to the flange. The distal end of the arm is attached to the panel at a specific location so that when the panel is closed relative to the frame the gooseneck can retain the hinge end of the panel. Often times a latch assembly is positioned spaced from the hinges to provide a locking feature to retain the panel in a closed position over the opening defined by the frame.

Some gooseneck hinges are provided with a locking mechanism to allow the hinge to lock in an open position once the panel is displaced relative to the frame. This allows the panel to be held by the hinges in an open position. The locking feature of the gooseneck hinge can be useful to further reduce the number of parts that are required in an assembly. It may be useful to reduce the number of parts because it can decrease initial installation time and can reduce the cost associated with the hinge assembly maintenance, and repair. As an example, prior art designs may have used a separate hold open rod to hold the panel in the open position relative to the frame once it is displaced to the open position. The use of a locking mechanism associated with the hinge helps eliminate such a hold open rod assembly space use, installation, cost, weight, and maintenance.

As an additional matter, some prior art hinge assemblies are custom designed for each specific application. In this regard, multiple hinge assemblies may be designed to hold and hinge a single panel. Other hinge assemblies can be designed for other panels. However, it would be useful to reduce the number of parts managed, parts inventories maintained, and increase the number of parts bought by having a single more universal hinge assembly which can be used for a variety of panel and frame assemblies. In this regard, it would be useful to provide a hinge assembly which increases the degree of motion to facilitate movement of the panel relative to the frame thereby facilitating the use of a single type of hinge for multiple applications. The use of a gooseneck hinge can be useful in this application because it can provide extended displacement of the panel relative to the frame.

This background information is provided to provide some information believed by the applicant to be of possible relevance to the present disclosure. No admission is intended, nor should such admission be inferred or construed, that any of the preceding information constitutes prior art against the present disclosure. Other aims, objects, advantages and features of the disclosure will become more apparent upon reading of the following non-restrictive description of specific embodiments thereof, given by way of example only with reference to the accompanying drawings.

BRIEF DESCRIPTION OF THE DRAWINGS

The present disclosure will be described hereafter with reference to the attached drawings which are given as a non-limiting example only, in which.

Figure 1:
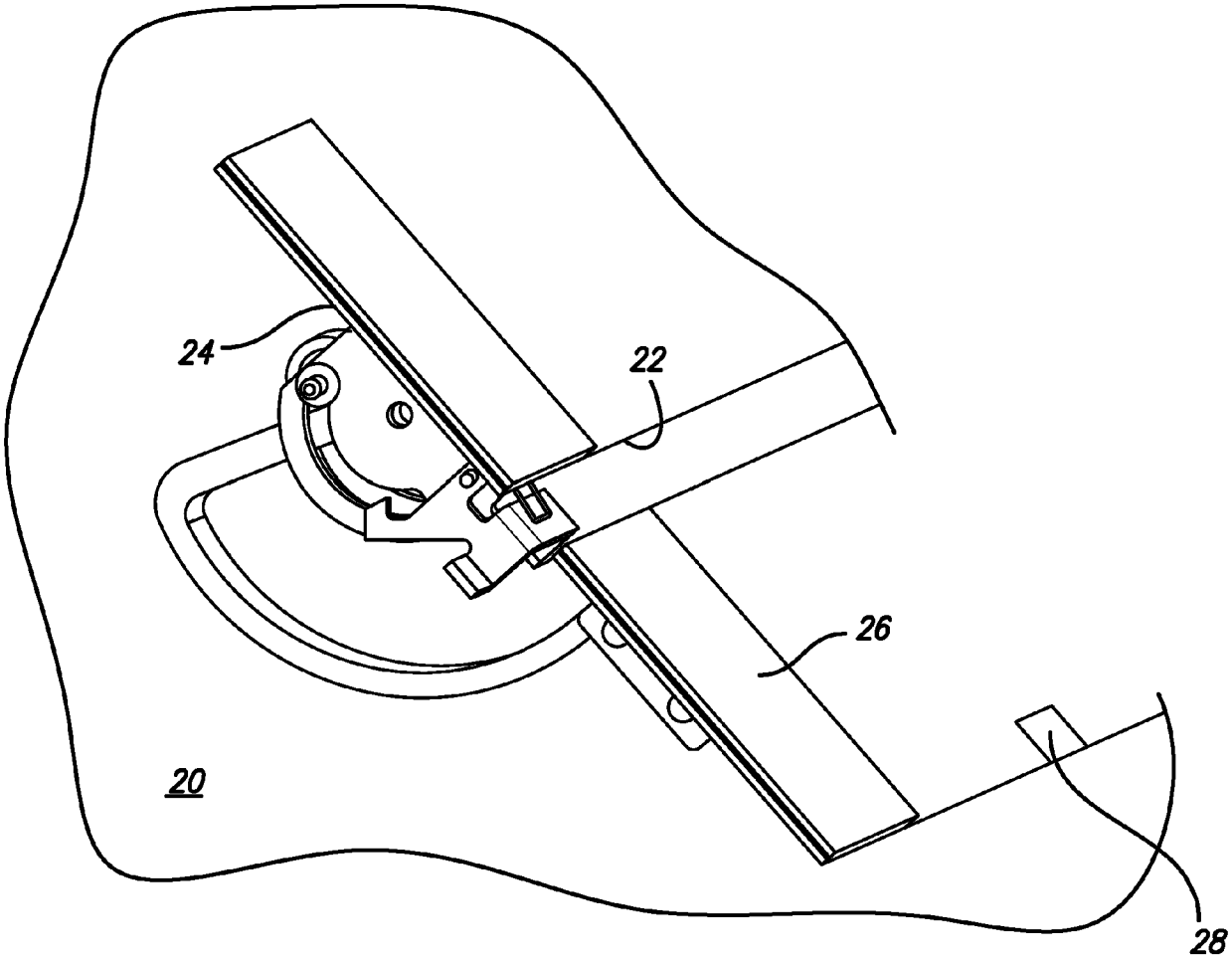
FIG. 1 is a perspective view to illustrate a panel in a closed position over an opening defined by a corresponding body portion, the body portion being a section of an aircraft with the panel being displaceable on a hinge assembly disclosed herein to facilitate access to areas within the body of the aircraft.

The exemplification set out herein illustrates embodiments of the disclosure that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure. The disclosure is not limited in its application to the details of structure, function, construction, or the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of various phrases and terms is meant to encompass the items or functions identified and equivalents thereof as well as additional items or functions. Unless limited otherwise, various phrases, terms, and variations thereof herein are used broadly and encompass all variations of such phrases and terms. Furthermore, and as described in subsequent paragraphs, the specific configurations illustrated in the drawings are intended to exemplify embodiments of the disclosure. However, other alternative structures, functions, and configurations are possible which are considered to be within the teachings of the present disclosure. Furthermore, unless otherwise indicated, the term "or" is to be considered inclusive.

Figure 2:
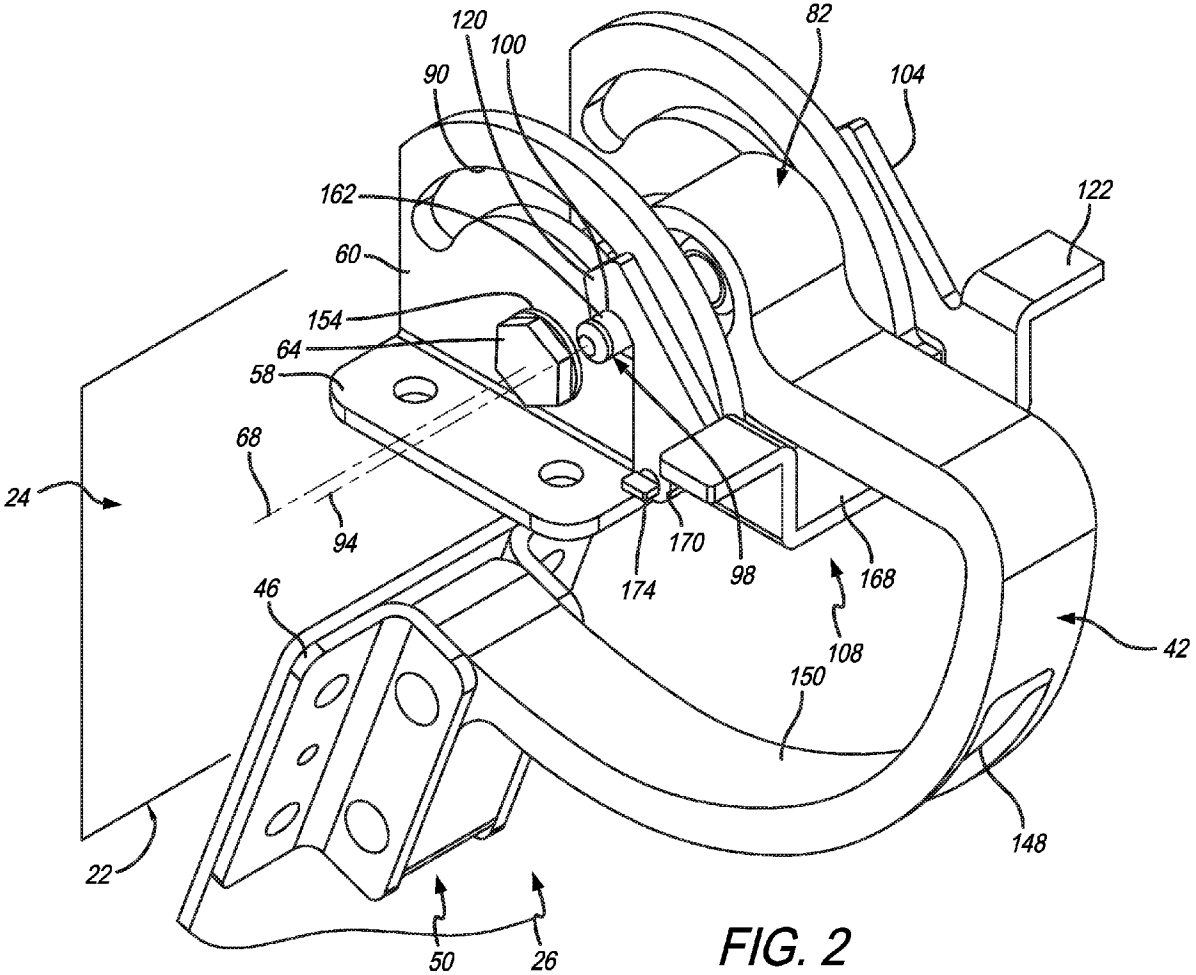
FIG. 2 is an illustration showing the panel displaced relative to the body to provide an opening facilitating access to the inside of the aircraft for a variety of purposes including such activities as maintenance of components retained within the aircraft.
Figure 3:
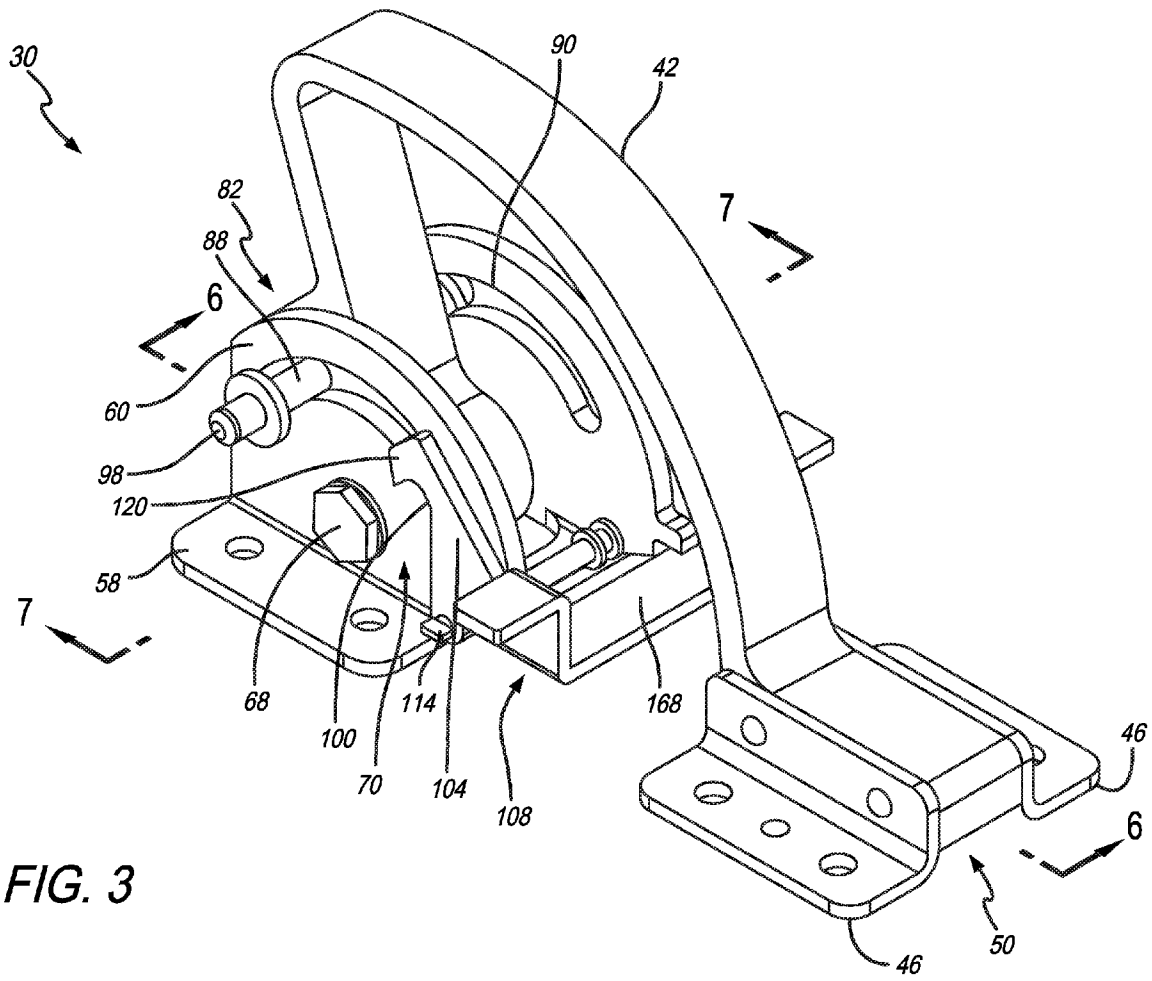
FIG. 3 is a perspective view of the hinge assembly showing a frame mounting portion, a link in the form of a gooseneck arm portion, and a panel mounting portion with a latch retained relative to the frame mounting portion for facilitating retaining the hinge in an open position.
Figure 4:
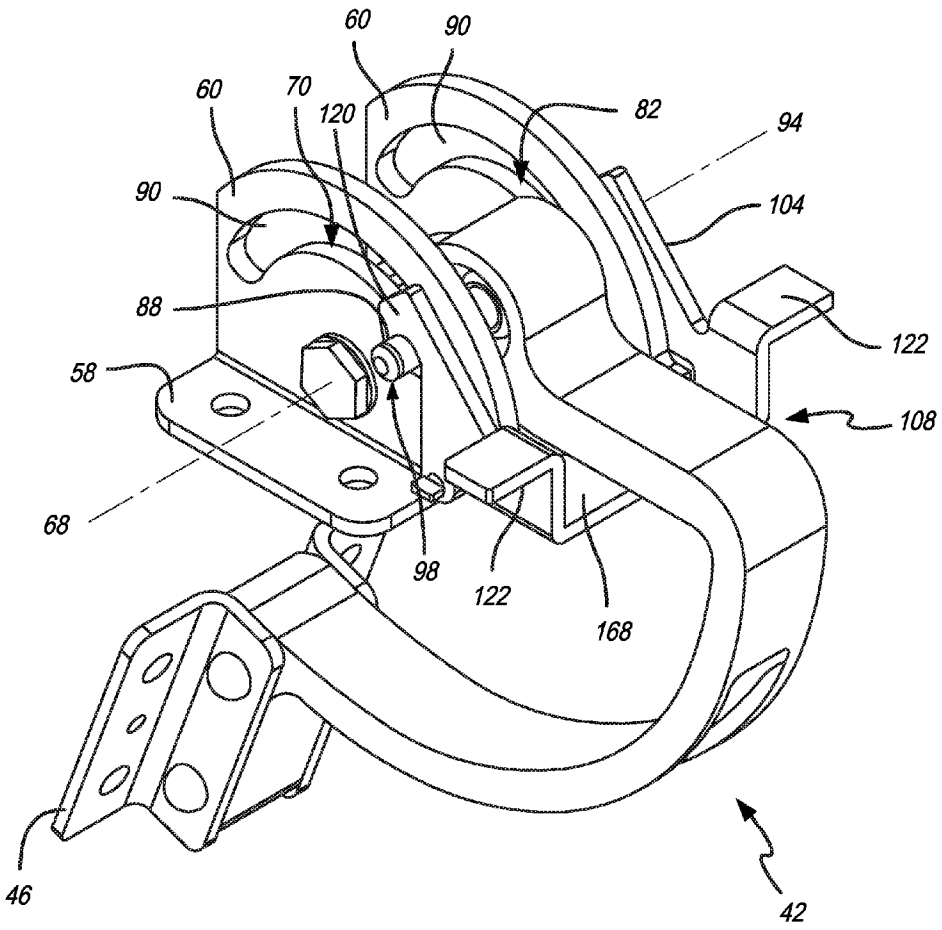
FIG. 4 is an illustration of the latch as shown in FIG. 3 which has been displaced to rotate a bearing end of the gooseneck arm relative to the frame mounting and showing displacement of the panel away from an opening defined by the frame with the latch assembly retaining a portion of the bearing end.

As shown in FIGS. 1 and 2 various aircraft and other devices have an outer portion or body which may be interrupted, as needed by design, to provide access to equipment and other systems located within the body 20. In such circumstances, the body is formed with an opening 22 which may be defined in general by a frame element 24 having a panel 26 being used to close the opening 22. FIG. 1 shows the panel 26 in a generally closed position over the opening 22. FIG. 2 shows the panel 26 displaced from the opening 22 showing the panel oriented in an open position. In the closed position a latch or other locking device 28 alone or in combination with other similar systems is used to retain the panel in the closed position. As shown in FIG. 2, one or more hinge assemblies 30 may be attached to the panel to retain it relative to the frame 24. The hinge assemblies 30 facilitate displaceable retention and movement of the panel 26 relative to the frame 24. With further reference to FIGS. 3 and 4, the hinge assembly 30 is shown in a closed position (FIG. 3, analogous to FIG. 1) and an open position (FIG. 4, analogous to FIG. 2). These structures and functions of the hinge assembly 30 will be described in greater detail herein below.

As shown in FIGS. 3 and 4, the hinge assembly 30 includes the frame mounting portion 34 and a panel mounting portion 38. A link 42 is illustrated in the form of a gooseneck arm. References is broadly made to the link 42 so that the broadest possible interpretation of the structure moveably attached to the frame mounting 34 and attached to the panel mounting 38 can be defined in the present description. While a "gooseneck" structure can be used, a variety of other configurations presently known or hereafter developed are also considered to be appropriate for the link 42. While the link 42 is illustrated as a single component it is possible that a multipiece link which is fixed or articulable could be used While the following description will make reference to the link 42 as being a gooseneck configuration the structure is intended to be interpreted in the broadest possible manner and is provide as an illustration but not a limitation of the present invention.

Similarly, while the panel mounting portion 38 is typically a pair of brackets 46 attached to a distal end 50 of the link 42 other variations on the panel mounting 38 can be envisioned. As such, the panel mounting portion, while shown as being a fixed element could be any version of elements required to achieve the structural and functional objections of the hinge assembly 30. As such, the panel mounting portion 38 as shown herein is provided by way of illustration and not limitation.

The frame mounting portion 34 includes a pair of frame brackets 54 which are defined by corresponding pairs of slate 58 and extending flanges 60. The flanges include mounting passages 152 for a shaft 64 extending from one flange to the other flange providing an axis 68 of attachment and movement relative to the frame bracket 54. As will be described in greater detail below, a first spherical bearing assembly 70 is carried on and moves relative to the shaft 64 along the axis of attachment and movement. The spherical bearing assembly 70 includes the end of the link at the bearing end 74 which provides structure to house and retain a spherical bearing 78.

A second spherical bearing assembly 82 is spaced from the first spherical bearing assembly 70. The second spherical bearing assembly 82 includes a shaft 88 extending through the bearing assembly 82. A pair of generally arcuate passages 90 are defined in the corresponding flanges 60, 60 of the corresponding frame bracket 54, 54. The shaft 88 helps maintain the position of the link 42 relative to the frame mounting assembly 34.

As noted above, the first spherical bearing assembly 70 is retained along the axis of attachment and movement 68. As such, a degree of side to side movement or angular movement of the link 42 is facilitated by the bearing assembly 70. This helps to allow the hinge attached to the panel 26 to be securely retained relative to the frame 24 but to provide a degree of linear as well as angular displacement movement of the panel 26 relative to the frame 24.

The second spherical bearing assembly 82 similarly provides a degree of movement but generally limits movement to translational movement along an axis 94 extending through the shaft 88 associated with the second spherical bearing assembly 82. The combination of the first and second spherical bearing assemblies provides a degree of movement or articulation of the hinge which compensates for panel contours relative to the frame assembly. For example, if a panel provides a variety of contours the movement of the hinge may not merely be along a linear path. Rather, movement of the panel relative to the frame using the hinge may require more complex adjustable movements during the opening and closing of the panel relative to the frame. The hinge assembly as disclosed herein accommodates the variations associated with panels and frames. Also, the use of the hinge as disclosed facilitates use of a single type of hinge with a variety of panels having a variety of contours.

The hinge assembly 30 as described herein also includes a latching feature which allows the hinge to be latched in an opening position (see FIGS. 2 and 4) thereby eliminating the need for an additional structure to maintain the panel 26 in an open position relative to the frame 24. In this regard, the shaft 88 includes ends 98 which extend beyond the outboard surfaces of the corresponding flanges 60. These ends provide a structure which can be captured by a latching notch 100 defined by a latching arm 104 carried on a latch assembly 108. The latch assembly includes the latching arm, a rod 112 extending through the latching arms 104, the corresponding flanges 60. The rod 112 defines an axis of rotation 114 to facilitate movement of the latching arms 104 relative to the flanges 60.

In the unlocked position, a spring 118 biases the latch assembly 108 in a "locking" position. In this position, the latching arms 104 are positioned in a spring biased orientation towards the frame 24. As the shaft 88 is rotated towards a head 120 of the latching arms 104 it draws against the arms and the spring force to engage in the latching notch 100. The extent of movement of the shaft 88 in the arcuate passages 90 is designed to be at approximately the same position as the latching notch 100. As such, the shaft 88 can dead stop in the arc 90 and be retainably latched by the latching arms 104 in a locked "open" position.

When the latching assembly 108 is to be disengaged the operator presses against the arms 122 on the latch to overcome the spring force and disengage the shaft 88 from the latching notch 100. Rotary movement of the latching assembly 108 about the axis of rotation 114 results in disengaging the notch 100 from the corresponding ends 98 of the shaft 88. Disengagement of the latching assembly 108 from the shaft 88 of the second spherical bearing assembly 82 allows the panel to be repositioned over the opening 22 to close the opening.

Figure 5:
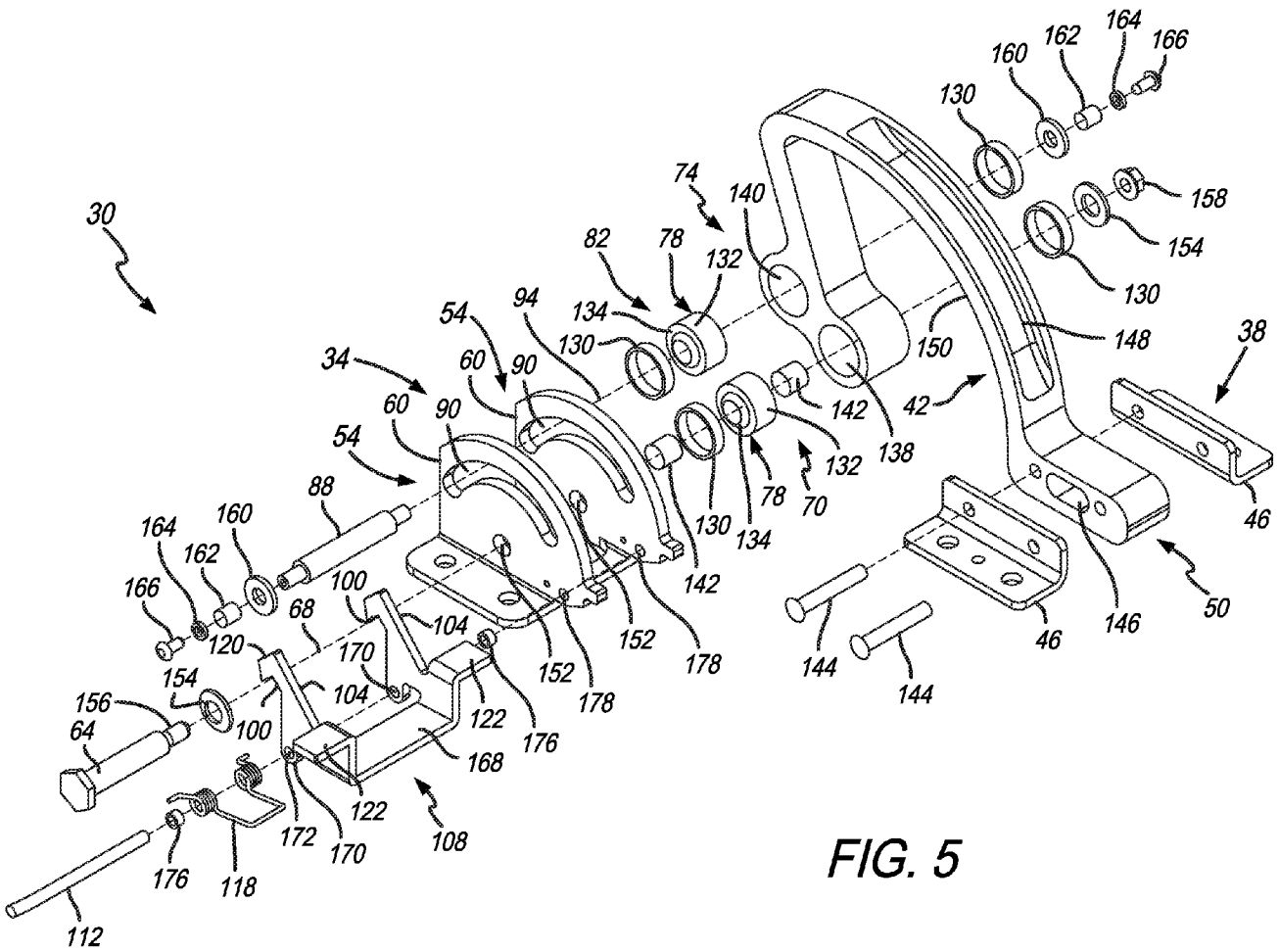
FIG. 5 is an exploded perspective view of the components of the hinge assembly showing the various specific components comprising the frame mounting, bearing assembly carried on the bearing end of the gooseneck arm, a panel mounting portion, and the latch assembly.
Figure 6:
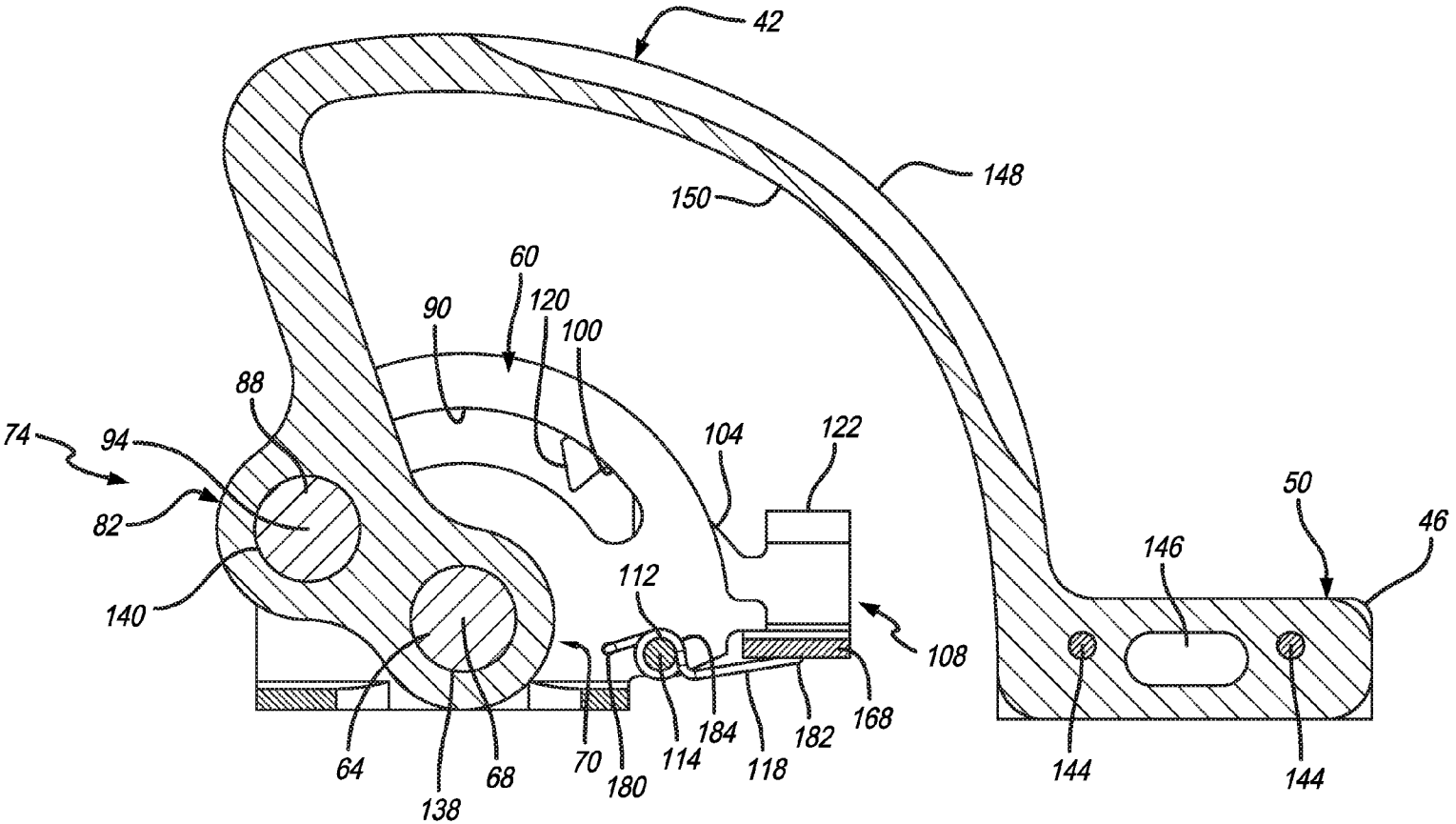
FIG. 6 is a cross-sectional side elevational view taken along line 6-6 in FIG. 3 showing the relationship of the various structures of the hinge assembly.
Figure 7:
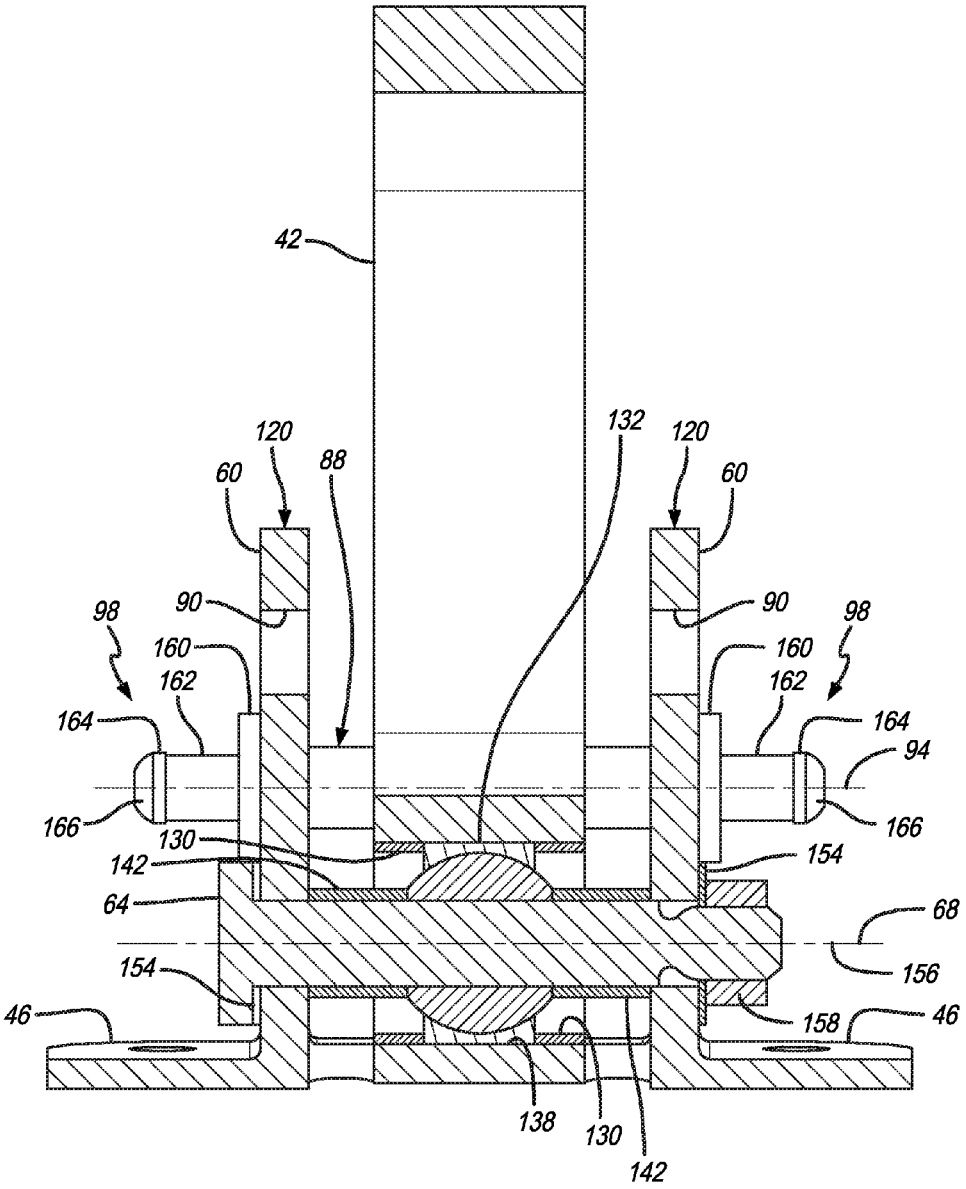
FIG. 7 is a cross-sectional view taken along line 7-7 in FIG. 3 providing additional information about the relationship of a first spherical bearing to a second spherical bearing which helps facilitate multiple degrees of motion of the bearing end to facilitate movement of a panel attached to the mounting end of the gooseneck arm.

Turning now to more detail discussion of the individual parts used in the described operation, referenced made to the exploded perspective view of the hinge assembly 30 as shown in FIG. 5 in combination with the cross sectional illustrations as shown in FIGS. 6 and 7.

With regard to FIG. 5, the exploded perspective view shows the numerous components of the latch assembly identified in relation to the other corresponding components. For example, it can be seen that the gooseneck arm 42 has a bearing end 74 and a distal end 50. The bearing end includes the first bearing assembly 70 and the second bearing assembly 82. Both bearing assemblies include corresponding sleeves 130 positioned on either side of the corresponding circle bearings which include a race 132 and a corresponding ball 134 retained within the race 132. The assembled sleeves and bearings are retained in the corresponding bores 138, 140. The first bearing assembly 70 also includes corresponding spacers 142 positioned on either side of the bearing assembly 78 to facilitate angular movement that restrict translational movement. The spacers 142 are not provided with regard to the second bearing assembly 82 so as to provide some degree of translational movement relative to the shaft 88.

The distal end 50 includes the brackets 46 with corresponding fasteners 144, shown in the form of a rivet, to retain the brackets 46 on the distal end 50. A passage 146 has been formed in the distal end to provide additional weight reduction of the overall assembly. Similarly, a recessed area 148 is formed a central arcuate portion 150 of the gooseneck 42. This area has also been engineered to reduce the mass of the assembly without compromise of the structural function and integrity of the assembly.

As also shown in FIG. 5, the shaft 64 extends along the axis 68 through the corresponding passages 152 formed through the flanges 60. The central portion of the shaft 64 extends through the corresponding spacers 142, sleeves 130, bearing assembly 78 and bore 138. Corresponding washers 154 are provided on either end of the flange 60 with a threaded end 156 of the shaft 64 engaging the corresponding nut 158 to retain the assembly 70 in engagement at the bearing end 74.

The second bearing assembly 82 is similarly assembled with the shaft 88 extending through the passages 90, sleeve 130, bearing assembly 78 and bore 140. Corresponding washers 160, bushings 162, flat washers 164 and engaging screws 166 retain the second assembly 82 in position at the bearing end 74.

With further reference to FIG. 5, the latch assembly 108 is shown with the latching arms 104 extending from a corresponding cross bar 168 with the arms 122 extending therefrom. Pivot knuckles 170 include passages 172 extending there through for receipt of the rod 112. The rod extends through the corresponding bushings 176 and passages 178 on the corresponding flanges 60. As assembled the latch assembly 108 positions the pivot knuckles 170 on the outside portion of the flanges 60 with the biasing spring 118 contained inwardly of the corresponding flanges 60. Retained ends 180, 180 of the spring 118 are engaged in the corresponding flanges 60, 60 and a leading end 182 of the spring 118 between the coils 184 is positioned against the cross bar 168. The bushings 176 are positioned between the pivot knuckles 170 and the corresponding outside surface of the flanges 60.

With regard FIGS. 6 and 7, cross sectional views have been taken along corresponding lines 6-6 in FIGS. 3 and 7-7 in FIG. 3. These cross sectional views show the assembled relationship of the bearing assembly 70 (FIG. 7) and the corresponding assembled relationship of the latch assembly 108.

In use, the hinge assembly 30 is attached to a corresponding frame 24 and panel 26 with the frame mounting end 34 and the panel mounting end 38, respectively. A pair of bearing assemblies 70, 82 is operatively retained on the frame mounting end 34 whereas the panel mounting end 38 is generally fixed to the panel. A gooseneck arm extends between these mounting locations to facilitate movement of the panel 26 relative to the frame 24. In an open position a latch assembly 108 can retain the hinge assembly 30 in an open position. At the discretion of the user, the latch assembly 108 can be released to allow the hinge to facilitate closure of the panel 26 over the opening 22 in the frame element 24.

The first bearing assembly 70 includes the spherical bearing 78 to facilitate a degree of angular motion relative to the mounting 34. Similarly, the second bearing assembly 82 includes a second bearing 78 to facilitate additional angular motion. However, the operative association of the components facilitates translational motion of the second bearing assembly 82 carried on shaft 88 along and coaxial with the axis 94. The combination of the bearing assemblies 70, 82 facilitates additional movement and control of the hinge assembly 30.

The foregoing terms as well as other terms should be broadly interpreted throughout this application to include all known as well as all hereafter discovered versions, equivalents, variations and other forms of the abovementioned terms as well as other terms. The present disclosure is intended to be broadly interpreted and not limited.

While the present disclosure describes various exemplary embodiments, the disclosure is not so limited. To the contrary, the disclosure is intended to cover various modifications, uses, adaptations, and equivalent arrangements based on the principles disclosed. Further, this application is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims. The scope of the following claims is to be accorded the broadest interpretation so as to encompass all such modifications and equivalent structures and functions.

The invention claimed is:

1. A hinge assembly comprising:

a frame mount including a pair of spaced apart frame brackets, each frame bracket formed to include a hole and an arcuate passage therethrough, the arcuate passage spaced apart from the hole;

a link including a bearing end and a spaced apart distal end, the bearing end including a first bore and a spaced apart second bore;

a first shaft configured to extend through the holes of the frame brackets along a first axis;

a second shaft configured to extend through the arcuate passages of the frame brackets along a second axis and to move along the arcuate passages about the first axis;

a first spherical bearing positioned in the first bore of the bearing end of the link and aligned along the first axis to receive the first shaft therethrough;

a second spherical bearing positioned in the second bore of the bearing end of the link and aligned along the second axis to receive the second shaft therethrough;

wherein the first and second spherical bearings are configured to allow the link to rotate relative to the frame mount about the first axis and at least a third axis extending through the first and second axes.

2. The hinge assembly of claim 1, wherein a central portion of the link extending between the bearing end and the distal end is formed in a gooseneck arm configuration.

3. The hinge assembly of claim 1, wherein the arcuate passages each include a first end and second end spaced apart from the first end, and wherein the link is movable about the first axis between a closed position where the second shaft is positioned at the first end of the arcuate passages and an opened position where the second shaft is positioned at the second end of the arcuate passages.

4. The hinge assembly of claim 3, further comprising a latch coupled to the frame mount and configured to grip the second shaft to block movement of the second shaft about the first axis at the selection of a user when the link is in the open position.

5. The hinge assembly of claim 1, wherein the first axis is substantially parallel to and spaced apart from the second axis.

6. The hinge assembly of claim 5, wherein the third axis extends perpendicularly through each of the first and second axes.

7. The hinge assembly of claim 6, wherein the arcuate passages are spaced apart from the holes at a substantially continuous radial distance about the first axis.

8. A hinge assembly for use in a hinged attachment of a panel relative to a frame and providing movement of the panel relative to the frame to close or open an opening of the frame, the hinge assembly comprising:

a frame mount configured to be coupled to the frame and including a pair of spaced apart frame brackets, each frame bracket formed to include a hole and an arcuate passage therethrough, the arcuate passage spaced apart from the hole;

a link including a bearing end and a spaced apart distal end, the bearing end including a first bore and a spaced apart second bore, the distal end configured to be coupled to the panel;

a first shaft configured to extend through the holes of the frame brackets along a first axis;

a second shaft configured to extend through the arcuate passages of the frame brackets along a second axis and to move along the arcuate passages about the first axis;

a first spherical bearing positioned in the first bore of the bearing end of the link and aligned along the first axis to receive the first shaft therethrough;

a second spherical bearing positioned in the second bore of the bearing end of the link and aligned along the second axis to receive the second shaft therethrough;

wherein the first and second spherical bearings are configured to allow the link to rotate relative to the frame mount about the first axis between a closed position where the panel is closed over the opening of the frame and an open position where the panel is spaced apart from the opening of the frame and configured to allow the link to rotate about at least a third axis extending through the first and second axes.

9. The hinge assembly of claim 8, wherein the arcuate passages each include a first end and second end spaced apart from the first end, and wherein the link is movable about the first axis between the closed position where the second shaft is positioned at the first end of the arcuate passages and the opened position where the second shaft is positioned at the second end of the arcuate passages.

10. The hinge assembly of claim 9, further comprising a latch coupled to the frame mount and configured to grip the second shaft to block movement of the second shaft about the first axis at the selection of a user when the link is in the open position.

11. The hinge assembly of claim 8, wherein the first axis is substantially parallel to and spaced apart from the second axis.

12. The hinge assembly of claim 11, wherein the third axis extends perpendicularly through each of the first and second axes.

13. The hinge assembly of claim 12, wherein the arcuate passages are spaced apart from the holes at a substantially continuous radial distance about the first axis.

14. The hinge assembly of claim 8, wherein a central portion of the link extending between the bearing end and the distal end is formed in a gooseneck arm configuration.

15. The hinge assembly of claim 14, further comprising a panel mount coupled to the distal end of the link and configured to be coupled to the panel.

16. A hinge assembly comprising:

a frame mount including a pair of spaced apart frame brackets, each frame bracket formed to include a hole and an arcuate passage therethrough, the arcuate passage spaced apart from the hole;

a link including a bearing end and a spaced apart distal end, the bearing end including a first bore and a spaced apart second bore and configured to be received between the frame brackets;

a first shaft configured to extend through the holes of the frame brackets;

a second shaft configured to extend through the arcuate passages of the frame brackets and to move along the arcuate passages, the second shaft positioned substantially parallel to the first shaft;

a first spherical bearing positioned in the first bore of the bearing end of the link and configured to receive the first shaft therethrough;

a second spherical bearing positioned in the second bore of the bearing end of the link and configured to receive the second shaft therethrough;

wherein the first and second spherical bearings are configured to allow the link to rotate relative to the frame mount about at least two non-parallel axes.

17. The hinge assembly of claim 16, wherein the arcuate passages each include a first end and second end spaced apart from the first end, and wherein the link is movable between a closed position where the second shaft is positioned at the first end of the arcuate passages and an opened position where the second shaft is positioned at the second end of the arcuate passages.

18. The hinge assembly of claim 17, further comprising a latch coupled to the frame mount and configured to grip the second shaft to block movement of the second shaft at the selection of a user when the link is in the open position.

19. The hinge assembly of claim 16, wherein the at least two non-parallel axes are perpendicular to one another.

* * * * *